US010932973B2

(12) United States Patent
Hart

(10) Patent No.: US 10,932,973 B2
(45) Date of Patent: Mar. 2, 2021

(54) PORTABLE LIGHT WEIGHT APPARATUS

(71) Applicant: David J. Hart, Simi Valley, CA (US)

(72) Inventor: David J. Hart, Simi Valley, CA (US)

(73) Assignee: David J. Hart, Simi Valley, CA (US)

( * ) Notice: Subject to any disclaimer, the term of this patent is extended or adjusted under 35 U.S.C. 154(b) by 0 days.

(21) Appl. No.: 16/221,887

(22) Filed: Dec. 17, 2018

(65) Prior Publication Data

US 2020/0188216 A1 Jun. 18, 2020

(51) Int. Cl.

| | |
|---|---|
| ***A61G 7/10*** | (2006.01) |
| *A61H 3/02* | (2006.01) |
| *A45B 9/04* | (2006.01) |
| *A45B 7/00* | (2006.01) |

(52) U.S. Cl.

CPC ..... *A61G 7/1038* (2013.01); *A61G 7/1011* (2013.01); *A45B 7/00* (2013.01); *A45B 9/04* (2013.01); *A61H 3/02* (2013.01)

(58) Field of Classification Search

CPC .. A61G 5/14; A61G 7/1011; A61H 2003/001; A45B 7/00

See application file for complete search history.

(56) References Cited

U.S. PATENT DOCUMENTS 2,817,387 A * 12/1957 Blake ..... A61H 3/00 135/67
4,232,863 A * 11/1980 Roach ..... A63B 21/00047 482/141
D265,575 S * 7/1982 Lunford ..... D21/691
4,995,412 A * 2/1991 Him ..... A61H 3/00 135/67
5,074,549 A * 12/1991 Harvey ..... A63B 23/0494 482/105
6,692,417 B2 * 2/2004 Burrell ..... A63B 21/00047 482/141
7,862,122 B1 * 1/2011 Shammas ..... B60N 2/245 297/411.23
10,292,884 B2 * 5/2019 Silverstein ..... A61G 7/1038
2015/0320631 A1 * 11/2015 Bordan ..... A61H 3/00 135/67

FOREIGN PATENT DOCUMENTS

CA 2392413 A1 * 1/2003 ..... A47C 12/02

* cited by examiner

*Primary Examiner* — David R Dunn
*Assistant Examiner* — Danielle Jackson

(57) ABSTRACT

An apparatus that allows a user with limited mobility to accomplish tasks such as repairs and inspections around and under the house, RV, boat or vehicle that are difficult for a user with mobility limitations to do without the apparatus, beginning with a first side that is adjustable of approximately 6 to 12 inches from a floor surface, a second side that is adjustable of approximately 12 to 18 inches from a floor surface, a third side that is adjustable of approximately 18 to 28 inches from a floor surface, and comprised of handrails on the surface of the apparatus, making it easy for a user to grip anywhere on the apparatus for easy gripping for the user to either raise themselves up from the floor or lower themselves to the floor, utilizing one of the apparatuses sides at a time, by turning the apparatus over to one of its multiple sides of varying length from the floor.

1 Claim, 3 Drawing Sheets

PORTABLE LIGHT WEIGHT APPARATUS

BACKGROUND

Field of the Invention

The apparatus described generally relates to personal dignity and methods for enabling a user to raise himself up from the floor or lower himself to the floor, using the PLWA.

Background Art

What differentiates this apparatus from prior art is that a user can travel with it due to its light design, or take it with him or her around the house or on a road trip, in which it can be used to help a user raise him- or herself to a standing position from the floor surface or vice versa. There are two main characteristics of this apparatus, which is that (1) it's made of sturdy and light-weight material, such as at least one of PVC piping composition, aluminum, plastic and rubber, in which it is portable in nature and (2) each one of the multiple sides of the apparatus has a different length in which a user can raise himself to a standing position from the floor surface or vice versa by reversing the order of apparatus by rotating it on its sides in decreasing length.

The apparatus is ideal for around the house activities, such as lowering oneself to search under a bed, sink or vehicle and then using it to stand back up again, or an extracurricular activity such as camping, fishing or boating. The apparatus is light enough to carry anywhere.

The most important distinction of the PLWA from any prior art is that it is designed to have all of its sides utilized on the floor surface, depending on the leverage the user is trying to get from the apparatus.

BRIEF SUMMARY

Elderly individuals with limited mobility that used to enjoy do-it-yourself projects and working around the house, RV, boat or vehicle that have trouble lowering themselves to the floor and then standing up again, are dissuaded from continuing to do projects because of their limited mobility. In many circumstances, users find it easy to lower themselves to the floor where the tricky part is getting back up again. This is all too common with senior citizens. Such situations not only take away a person's dignity, but may also pose a risk to an individual attempting to work around the house in which that individual may seriously hurt themselves and/or hurt those coming to the aid of the individual trying to help the person get up.

DETAILED DESCRIPTION

The PLWA is made for a user, such as an elderly individual, with limited mobility who used to enjoy do-it-yourself projects and working around the house, RV, boat or vehicle, but now has difficulty lowering themselves to the floor surface and/or raising themselves to a standing position. In many circumstances, users find it easy to lower themselves to the floor surface.

However, the tricky part is getting back up again. This is all too common with senior citizens. Such situations not only take away a person's dignity, but may also pose a risk to an individual attempting to work around the house in which that individual may seriously hurt themselves and/or hurt those coming to the aid of the individual trying to help the person get up.

The PLWA has rubber contact points 106 and 111 that are replaceable. The PLWA has many handrails 102, 103, 104, 105, 107, 108, 109, 110, 202, 203, 302, and 303, on each of its sides that are light weight in design.

Regarding the adjustability of the PLWA, it can be purchased in different sizes, making it adjustable to a particular user's height.

Figure 1:
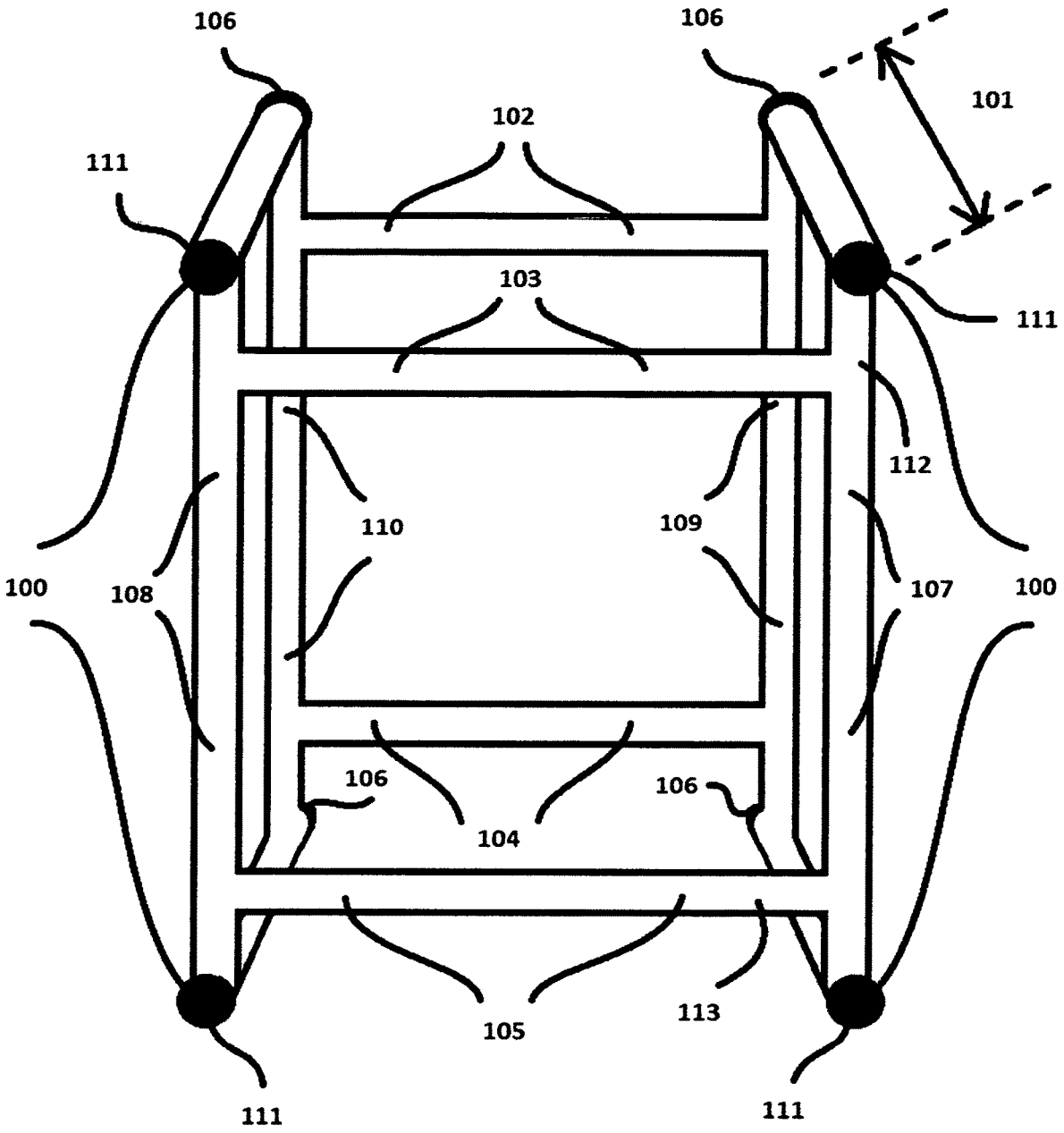
FIG. 1 is a perspective view of the first side of the apparatus illustrating the approximate length of the elevation from a floor surface.
Figure 2:
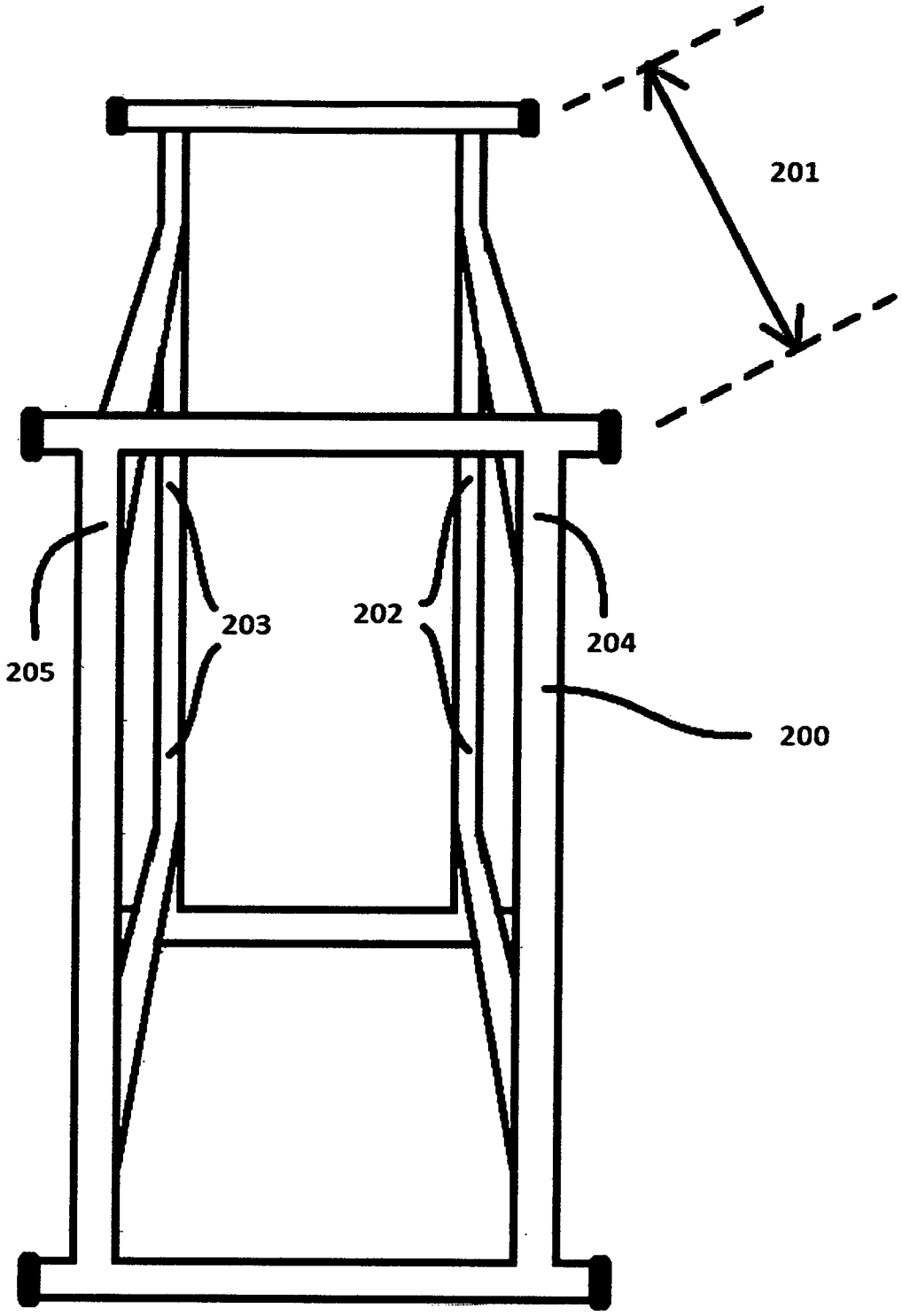
FIG. 2 is a perspective view of the second side of the apparatus illustrating the approximate length of the elevation from a floor surface.
Figure 3:
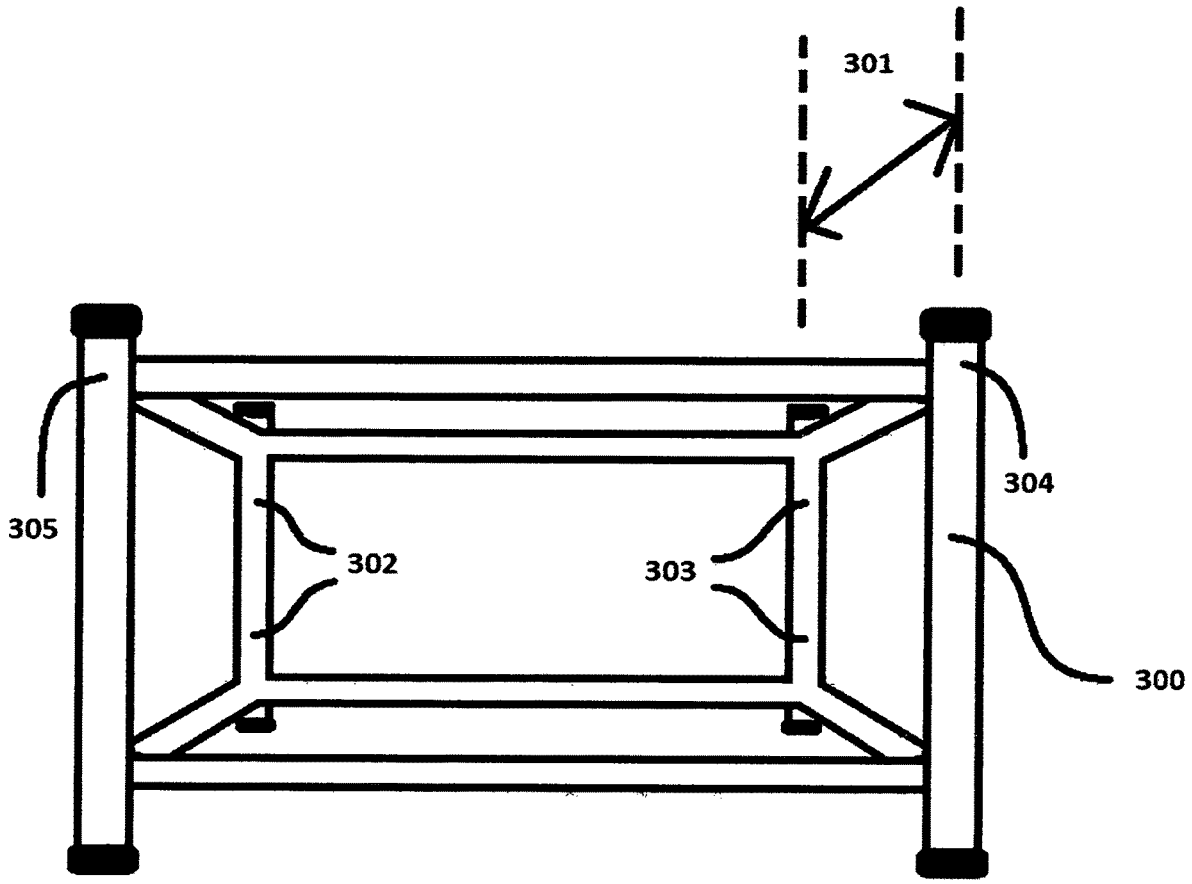
FIG. 3 is a perspective view of the third side of the apparatus illustrating the approximate length of the elevation from a floor surface.

The PLWA has 3 sides of differing length that can help the user raise himself from the floor. Referring particularly to FIG. 1 of the accompanying drawings, the PLWA's first side 100 is placed on a floor surface. If the user is trying to get up from the floor surface, the user will place the PLWA onto its first side 100, with approximately 6-12 inches from the floor surface, as referenced in 101. The endpoint rubber contact points 111 will come in contact with the floor surface. The user may grip the PLWA's handrails 107 and 109 from 112 and push himself off the floor surface to attempt to get his dominant knee on the floor surface. The user will then push against the PLWA's handrails, particularly 109, to get his other knee to firmly rest on the floor surface. Or, if the user wishes, the user can climb up the PLWA from the handrails 113 which may provide more stability, where the user will grip the PLWA's handrails 104 and 105. The PLWA can also be utilized from the opposite sides mentioned above; where the user can grip the PLWA's handrails from 108 and 110, or from the handrails of 102 and 103.

Once the user has both knees firmly resting on the floor surface, the user will then turn the PLWA onto its second side 200, with approximately 12-18 inches from the floor surface, as referenced in 201. With the PLWA facing the user, from side 204, the user will push up from the PLWA's handrail 202 to get his dominant foot to rest against the floor surface. Once his dominant foot is firmly established on the floor, the user will push up against the PLWA's handrail 202 to get his other foot to rest on the floor surface. The PLWA can also be utilized from the opposite side 205; where the user can grip the PLWA's handrail 203.

Once both feet are firmly established on the floor surface, the user will then turn the PLWA onto its third side 300, with approximately 18-28 inches from the floor surface, as referenced in 301. With the PLWA facing the user, from side 304, the user will push up from the PLWA's handrail 302 to straighten his body to a standing position. The PLWA can also be utilized from the opposite side 305; where the user can grip the PLWA's handrail 303.

The user can reverse the steps to lower himself to the floor.

What is claimed is:

1. A method of use of a portable light weight apparatus (PLWA), comprising:

placing the apparatus on a floor surface such that a first side of the apparatus is parallel to the floor surface and is approximately 6-12 inches from the floor surface to help a user raise himself from the floor surface;

turning the apparatus such that a second side of the apparatus is parallel with the floor surface and is approximately 12-18 inches from the floor surface to help the user raise himself closer to a standing position from the floor surface, where the user can use his dominant foot to push off of while the other leg is resting on its knee;

turning the apparatus such that a third side of the apparatus is parallel with the floor surface and is approximately 18-28 inches from the floor surface to help the user raise himself to a fully standing position from the floor surface.

* * * * *